US005246491A

United States Patent [19]

Takahashi et al.

[11] Patent Number: 5,246,491

[45] Date of Patent: Sep. 21, 1993

[54] PAPER SIZING AGENT COMPOSITION

[75] Inventors: Yoshio Takahashi; Shigeto Hatanaka, both of Kanagawa, Japan

[73] Assignee: Mitsubishi Oil Co., Ltd., Tokyo, Japan

[21] Appl. No.: 910,397

[22] Filed: Jul. 8, 1992

[30] Foreign Application Priority Data

Jul. 10, 1991 [JP] Japan ..... 3-194980

[51] Int. Cl.[5] ..... C09D 7/00

[52] U.S. Cl. ..... 106/287.24; 106/211; 162/175; 162/179

[58] Field of Search ..... 106/211, 287.24; 162/179, 175

[56] References Cited

U.S. PATENT DOCUMENTS 3,821,069 6/1974 Wurtburg ..... 162/179

4,207,142 6/1980 Shephard ..... 162/179

*Primary Examiner*—David B. Brunsman

*Attorney, Agent, or Firm*—Sughrue, Mion, Zinn, Macpeak & Seas

[57] ABSTRACT

An alkenylsuccinic anhydride type paper sizing agent composition which causes little contamination of a paper machine and exhibits an excellent sizing effect is provided.

The paper sizing agent composition contains addition reaction products obtained from an addition reaction between a straight-chain internal olefin comprising 16 to 20 carbon atoms and maleic anhydride, any unreacted olefin and maleic anhydride having been removed from said addition reaction products; said addition reaction products comprising as a main component alkenylsuccinic anhydride (1:1 adduct) represented by formula (I):

(I)

wherein both of R and R′ are alkyl groups or either one of R and R′ is an alkyl group while the other is a hydrogen atom; and a 1:2 adduct (2 moles maleic anhydride per mole of olefin), and a decarbonated product of said 1:2 adduct in a total amount, based on said addition reaction products, of from about 7 to about 12 mol%.

7 Claims, 1 Drawing Sheet

PAPER SIZING AGENT COMPOSITION

FIELD OF THE INVENTION

This invention relates to an alkenylsuccinic anhydride type paper sizing agent composition. More particularly, it relates to a sizing agent composition which causes little contamination in a paper machine when used in the form of an emulsion and exerts an excellent sizing effect.

BACKGROUND OF THE INVENTION

In the field of paper manufacturing, a large amount of a filler (for example, talc, clay) is normally employed in order to improve printability and whiteness and to impart opacity. In recent years, attempts have been made to substitute these conventional fillers with calcium carbonate which exists abundantly in Japan and is commercially available at a low price.

Suitable, commonly employed paper sizing agents include so-called anion type sizing agents such as rosin sizing agents which are normally fixed in pulp with the use of aluminum sulfate, namely, the acidic sizing method. When employed in this method as a filler, however, calcium carbonate is at least partially decomposed due to the acidic paper manufacturing system.

In order to solve this problem, therefore, various neutral sizing agents, capable of performing sizing within a neutral or alkaline region without using aluminum sulfate, have been proposed. For example, JP-B-39-2305 (corresponding to U.S. Pat. No. 3,102,064) discloses a neutral sizing agent represented by the following general formula (a) (the term "JP-B" as used herein means an "examined Japanese patent publication"):

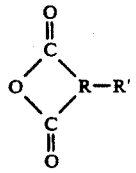

(a)

wherein R represents a group selected from a dimethyl group and a trimethyl group; and R' represents a group selected from an alkyl group, an alkenyl group, an aralkyl group and an aralkenyl group having 5 or more carbon atoms. JP-B-53-28526 (corresponding to U.S. Pat. No. 3,821,069) discloses a sizing agent comprising a product obtained by a reaction between an internal olefin represented by the following general formula (b):

$$R_x—CH_2—CH{=}CH—CH_2—R_y \quad (b)$$

wherein $R_x$ and $R_7$ each represent an alkyl group having from 4 to 10 carbon atoms; and maleic anhydride.

Further, JP-A-57-154495 discloses a sizing agent comprising mixed alkenylsuccinic anhydrides which are obtained by adding maleic anhydride to a $C_8$–$C_{18}$ straight-chain internal olefin mixture wherein double bonds are almost uniformly distributed at all positions except the α-position (the term "JP-A" as used herein means an "unexamined published Japanese patent application"). Furthermore, JP-A-59-179898 discloses a sizing agent containing a product obtained by an addition reaction between a $C_{14}$–$C_{36}$ straight-chain olefin mixture, wherein the content of olefins having a double bond at the 2-, 3- or 4-position is each from 10 to 65 mol% and the total content of these olefins is at least 70 mol%, with maleic anhydride or a hydrogenated product of the reaction product.

Furthermore, JP-A-60-99099 involves discussion on emulsifiers.

The above-mentioned conventional sizing agents are emulsified, for example, in a homomixer or a homogenizer with the use of a water soluble polymer compound such as cationized starch or a surfactant such as polyoxyalkylene aryl ether and then added, in the form of an aqueous emulsion, to a pulp slurry. However each of these sizing agents is insufficient in emulsifiability and stability after the completion of the emulsification, which results in certain problems including an unsatisfactory sizing effect, or contamination in the paper manufacturing system.

It is considered that the above-noted disadvantages may arise because a conventional alkenylsuccinic anhydride type sizing agent has a relatively wide size distribution of emulsified particles. In other words, fine particles of a particle size of 0.5 μm or less would undergo hydration within a short period of time following the addition to the pulp slurry and, as a result, the emulsion is broken. Therefore these fine particles never contribute to the achievement of the sizing effect but instead cause contamination in the paper production system. On the other hand, it is considered that large particles of a particle size exceeding 2 μm would scarcely contribute to the sizing effect, since the pulp surface area to be coated with these particles is limited.

In order to prevent the contamination of the paper manufacturing system and to achieve an excellent sizing effect, it is, therefore, desirable to use a sizing agent emulsion of a narrow size distribution of emulsified particles (i.e., around 1 μm). However, the prior art, i.e., by improving, for example, the structure of starting olefins, emulsifiers or emulsification procedures, does not teach or suggest an effective solution to this problem.

SUMMARY OF THE INVENTION

It is an object of the present invention to provide an alkenylsuccinic anhydride type sizing agent composition which causes little contamination in a paper machine and exerts an excellent sizing effect.

In order to achieve the above-mentioned object, the present inventors have conducted extensive studies. As a result, the inventors have found that a sizing agent composition comprising a particular molar content of the 1:2 adduct (i.e., a reaction product formed from 2 moles of maleic anhydride per mole of the straight-chain internal olefin, which is obtained as a side product during the production of an alkenylsuccinic anhydride (1:1 adduct) as the main product upon reaction of an olefin with maleic anhydride), and the decarbonated product of the 1:2 adduct, is highly effective in controlling emulsified particle size, thus completing the present invention. Although attempts have been made in the past to improve the sizing effect or to reduce the amount of contamination by selecting suitable starting olefins or emulsifiers, no attention has been paid to the above-mentioned 1:2 adduct and decarbonated product thereof which are formed as side products. Thus the present invention provides an alkenylsuccinic anhydride type sizing agent composition which has been discovered from a completely novel viewpoint.

That is, the present invention relates to a paper sizing agent composition comprising addition reaction products obtained from an addition reaction between a straight-chain internal olefin comprising 16 to 20 carbon atoms and maleic anhydride, any unreacted olefin and maleic anhydride having been removed from said addition reaction products; said addition reaction products comprising as a main component alkenylsuccinic anhydride (1:1 adduct) represented by formula (I):

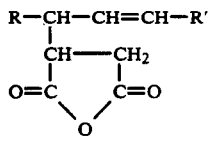

(I)

wherein both of R and R′ are alkyl groups or either one of R and R′ is an alkyl group while the other is a hydrogen atom; and a 1:2 adduct (2 moles maleic anhydride per mole of olefin), and a decarbonated product of said 1:2 adduct in a total amount, based on said addition reaction products, of from about 1 to about 12 mol%.

BRIEF DESCRIPTION OF THE DRAWINGS

The drawing is a schematic view of a contamination test machine wherein:

1 is a slurry box (liquid tank);
2 is a circulation pump;
3 is a slurry box (liquid tank);
4 is a slope; and
A is a pulp slurry.

DETAILED DESCRIPTION OF THE INVENTION

Figure 1:
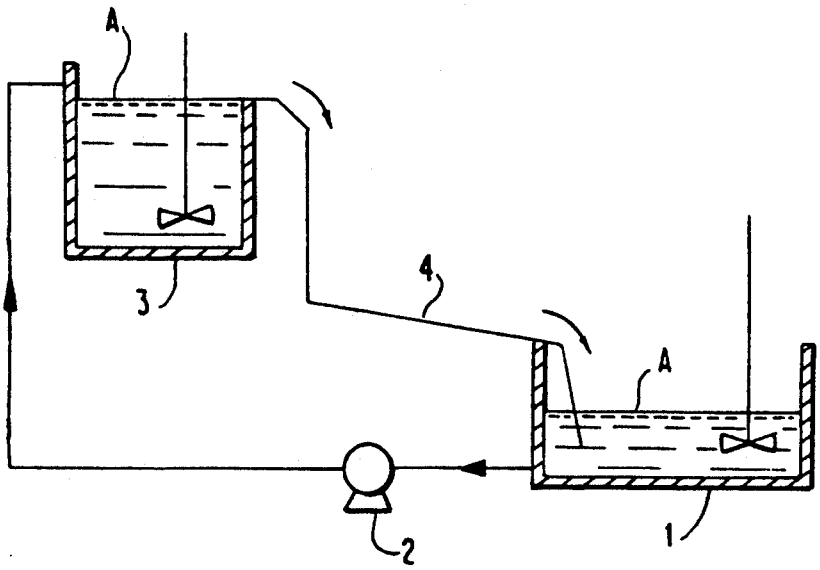

The paper sizing agent composition of the present invention comprises addition reaction products obtained from an addition reaction between a straight-chain internal olefin having 16 to 20 carbon atoms and maleic anhydride. As used herein, "addition reaction products" means the main and side products of such an addition reaction, but excludes any unreacted olefin and/or maleic anhydride. The main reaction product thus obtained is alkenylsuccinic anhydride (1:1 adduct) represented by the following formula (I):

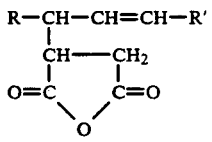

(I)

wherein both of R and R′ are alkyl groups or either one of R and R′ is an alkyl group while the other is a hydrogen atom. In the formula (I), the carbon range of the alkenyl group

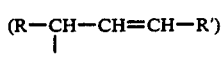

is 16 to 20.

"1:1 adduct" means that one mole of maleic anhydride is added per mole of olefin, as shown in formula (I). The two main "side products" of the addition reaction are the "1:2 adduct" (two moles of maleic anhydride added per mole of olefin), as shown in formula (II) below, and the decarbonated product thereof.

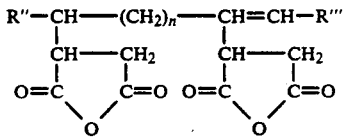

(II)

wherein both of R″ and R‴ are alkyl groups or either one of R″ and R‴ is an alkyl group while the other is a hydrogen atom. In the formula (II), the carbon range of the alkenyl group

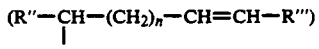

is 16 to 20.

"Decarbonated product" of the 1:2 adduct, as used herein, means that one or two succinic groups of formula (II) are decarbonated as shown in formula (III) below.

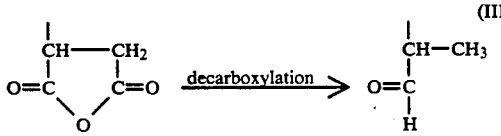

(III)

succinic group

The sizing agent composition of the present invention contains from about 7 to 12 mol% of the 1:2 adduct and the decarbonated product of the 1:2 adduct. The balance of the composition comprises mainly the 1:1 adduct, although trace amounts of the 1:3 adduct may also be found as discussed below.

During the addition reaction between internal olefin and maleic anhydride, the "1:2 adduct" is produced with the "1:1 adduct". The decarboxylation of the "1:2 adduct" also proceeds during the addition reaction. The decarboxylation is hardly controlled and usually 30 to 70% of the "1:2 adduct" is decarbonated.

The paper sizing agent composition of the present invention comprises the addition reaction products of an addition reaction between the above straight-chain internal olefin having 16 to 20 carbon atoms and maleic anhydride, containing from 7 to 12 mol%, based on total the amount of the addition reaction products thus-obtained, of a 1:2 adduct and the decarbonated product of the 1:2 adduct. However, the present invention is not restricted as to either the production process itself or to the method for adding the reactants (controlling the content) to obtain the 1:2 adduct and the decarbonated product thereof.

Suitable components which may be used as the starting straight-chain internal olefin include those obtained by isomerizing $C_{16}$–$C_{20}$ linear α-olefins or by dehydrogenating $C_{16}$–$C_{20}$ n-paraffins. Furthermore, olefins containing $C_{15}$ or less and $C_{21}$ or more, branched olefins, α-olefins or paraffins may be used as the starting olefin so long as they comprise one or more $C_{16}$–$C_{20}$ straight-chain internal olefins as the major component. However the effect thereof would be deteriorated if a substantial amount of these latter-described components are used in addition to the former-chain described $C_{16}$–$C_{20}$ straight-chain internal olefin. The composition of $C_{16}$–$C_{20}$ is desirably over 50 wt% based on the starting olefin.

The reaction between olefins and maleic anhydride has been studied, for example, in B. J. Sublett, J. Org. Chem. 26, 2594 (1961). And any method may be selected for the addition reaction between the straight-chain internal olefin and maleic anhydride, so long as the target 1:2 adduct and the decarbonated product thereof are formed thereby. This reaction may be performed either with or without using a catalyst. For example, the starting materials may be heated to 180° to 250° C. in the absence of a catalyst, preferably under an inert gas (for example, nitrogen gas) atmosphere, under atmospheric or elevated pressure higher than the vapor pressure of an olefin and maleic anhydride and maintaining this temperature for 1 to 30 hours. In the feeding step, the molar ratio of the starting materials is not particularly restricted. It is preferable to use from 0.5 to 3 mol of maleic anhydride per mol of the olefin. After the addition reaction, any unreacted olefin and maleic anhydride are removed by distillation from the reaction system.

The molar ratio of the formation of the 1:2 adduct and the decarbonated 1:2 adduct in the composition is increased as the temperature is elevated and the reaction time is prolonged. Therefore, the reaction conditions are appropriately controlled in such a manner as to adjust the content of the 1:2 adduct and the decarbonated product thereof to comprise from 7 to 12 mol% of the addition reaction products. Alternately, addition reaction products containing less than 7 mol% of the 1:2 adduct and the decarbonated product thereof may be blended with addition reaction products containing 12 mol% or more of the 1:2 adduct and the decarbonated product thereof so as to give a final content of the 1: 2 adduct and the decarbonated product thereof of from 7 to 12 mol%. When the content of the 1:2 adduct and the decarbonated product thereof is less than 7 mol%, the sizing effect is somewhat deteriorated and serious contamination is observed. When the content exceeds 12 mol%, on the other hand, the sizing effect is deteriorated, though little contamination is observed. Although a 1:3 adduct (3 moles of maleic anhydride added per mole of olefin) is also formed in a trace amount, the content thereof in the addition reaction products is less than 0.5 % by weight in a usual case and, therefore, its effect on the sizing function is negligible. The content of the 1:2 adduct and the decarbonated product thereof may be determined by usual analytical methods, for example, gas chromatography, high performance liquid chromatography or mass spectrometry.

When the paper sizing agent composition of the present invention thus obtained (which comprises addition reaction products obtained from the addition reaction of a straight-chain internal olefin and maleic anhydride as described above) is applied to sizing of pulp, the sizing agent composition is homogeneously dispersed in water and the emulsion thus obtained is added to a pulp slurry.

In order to facilitate the dispersion of the sizing agent composition in water, one or more emulsifiers (for example, polyoxyalkylene sorbitan fatty acid ester, polyoxyalkylene sorbitol fatty acid ester, polyoxyalkylene alkyl ether, polyoxyalkylene alkyl aryl ether, fatty acid ester of polyhydric alcohol, sulfate of polyoxyalkylene alkyl ether, polyoxyalkylene alkyl ether phosphate, polyoxyalkylene alkyl aryl ether phosphate, polyoxyalkylene aralkyl aryl ether phosphate) or suspending agents (for example, various cationic compounds such as cationized starch, cationic polyacrylamide) may be used, if required.

The amount of the emulsifier to be used together with the sizing agent composition in the present invention may be determined by taking the type of the emulsification device and dispersibility into consideration in a manner which would be well understood by one of ordinary skill in the art. It is preferable in general to use from 0.5 to 20% by weight, and more preferable to use from 1 to 10% by weight, of the emulsifier based on the weight of the straight-chain internal olefin/maleic anhydride addition reaction products described above.

The amount of the cationic compound, if employed as a suspending agent, preferably ranges from 30 to 600% by weight, more preferably from 100 to 300% by weight, based on the weight of the straight-chain internal olefin/maleic anhydride addition reaction products described above.

As the emulsification device, those employed for emulsifying conventional alkenylsuccinic anhydride type sizing agents (for example, homomixer, homogenizer, nozzle type emulsifying machine, orifice type emulsifying machine, turbine type emulsifying machine) may be used.

After the completion of the emulsification, the sizing agent composition of the present invention may be added to the pulp slurry at any desired step during the paper manufacturing process.

The amount of the sizing agent composition of the present invention to be added to the pulp slurry varies depending on the pulp employed, paper manufacturing conditions and the intended usage of the final product. Generally speaking, it is preferable to use from 0.05 to 3% by weight of the sizing agent composition of the present invention based on the dry weight of the pulp.

In order to fix the sizing agent composition of the present invention to the pulp, a fixer, usually a cationic compound (for example, cationized starch, cationic polyacrylamide, polyamine polyamide/epichlorohydrin resin), is used. The amount of the fixer may preferably range from 0.01 to 5% by weight, more preferably from 0.03 to 3% by weight, based on the dry weight of the pulp. This fixer may be added either simultaneously, before or after the addition of the sizing agent composition. However, it is preferable to add the fixer following the addition of the sizing agent composition in order to achieve the optimum fixing effect.

The sizing agent composition of the present invention may be used together with various sizing agents outside of the scope of the present invention in any desired ratio, if required, as would be apparent to one of ordinary skill in the art. Furthermore, any desired filler (for example, talc, clay, titanium dioxide, calcium carbonate, calcium sulfate, aluminum hydroxide) may be added in the sizing stage, as would also be recognized by one of ordinary skill in the art.

To further illustrate the present invention in greater detail, the following non-limiting Examples are provided below.

EXAMPLE 1

To 1,000 g of a $C_{16}$ straight-chain internal olefin (distribution of double bonds: 1-position: 0 mol%, 2-position: 13 mol%, 3-position: 12 mol%, 4-position: 15 mol%, 5+-position: 60 mol%) obtained by isomerizing a $C_{16}$ $\alpha$-olefin (Dialen 16 (tradename), a product of Mitsubishi Chemical Industries, Ltd.), 656 g of maleic anhydride (a product of Mitsubishi Chemical Industries, Ltd.) was added (maleic anhydride/olefin molar ratio: 1.5), followed by reacting in an autoclave at 215° C. for 8 hours without using a catalyst. After removing the unreacted olefin and maleic anhydride from the reaction mixture by distilling under reduced pressure, 1,408 g of olefin/maleic anhydride addition reaction products were obtained.

In order to determine the content of any 1:2 adduct formed (i.e., wherein 2 moles of maleic anhydride were added per mole of the straight-chain internal olefin), and the decarbonated product thereof, 2 g of methanol was added to 1 g of the reaction products. Then the reaction products were converted into monomethyl esters under reflux. Next, diazomethane was added so as to give diesters and the content of the 1:2 adduct and the decarbonated product of the 1:2 adduct was measured with an FID gas chromatograph. As a result, it was determined that the content of the 1:2 adduct and the decarbonated product thereof comprised 8.7 mol% based on the total addition reaction products; the remaining 91.3 mol% comprised mainly the 1:1 adduct described above, and a trace amount of the 1:3 adduct may also have been formed as indicated above, although precise measurement of the content thereof was not made. The same holds true for the balance of the addition reaction products in the following Examples and Comparative Examples.

EXAMPLE 2

The procedure of Example 1 was repeated except that the amount of the maleic anhydride was increased to 700 g (molar ratio: 1.6). As a result, 1,431 g of olefin/maleic anhydride addition reaction products were obtained and the content of the 1:2 adduct and the decarbonated product thereof was 9.9 mol%.

EXAMPLE 3

The procedure of Example 1 was repeated except that the amount of the maleic anhydride was increased to 744 g (molar ratio: 1.7). As a result, 1,450 g of olefin/maleic anhydride addition reaction products were obtained and the content of the 1:2 adduct and the decarbonated product thereof was 10.8 mol%.

COMPARATIVE EXAMPLE 1

The procedure of Example 1 was repeated except that the amount of the maleic anhydride was reduced to 438 g (molar ratio: 1.0). As a result, 1,152 g of olefin/maleic anhydride addition reaction products were obtained and the content of the 1:2 adduct and the decarbonated product thereof was 5.4 mol%.

COMPARATIVE EXAMPLE 2

The procedure of Example 1 was repeated except that the amount of the maleic anhydride was reduced to 525 g (molar ratio: 1.2). As a result, 1,260 g of olefin/maleic anhydride addition reaction products were obtained and the content of the 1:2 adduct and the decarbonated product thereof was 6.1 mol%.

COMPARATIVE EXAMPLE 3

The procedure of Example 1 was repeated except that the amount of the maleic anhydride was increased to 876 g (molar ratio: 2.0). As a result, 1,590 g of olefin/maleic anhydride addition reaction products were obtained and the content of the 1:2 adduct and the decarbonated product thereof was 13.8 mol%.

EXAMPLE 4

500 g of the olefin/maleic anhydride addition reaction products prepared in the above Comparative Example 1 (content of 1:2 adduct and its decarbonated product: 5.4 mol%) was blended with 500 g of the olefin/maleic anhydride addition reaction products prepared in the above Comparative Example 3 (content of 1:2 adduct and its decarbonated product: 13.8 mol%). Thus 1,000 g of olefin/maleic anhydride addition reaction products containing 9.6 mol% of the 1:2 adduct and the decarbonated product thereof were obtained.

EXAMPLE 5

To 1,000 g of a straight-chain internal olefin (distribution of double bonds: 1-position: 0 mol%, 2-position: 12 mol%, 3-position: 11 mol%, 4-position: 16 mol%, 5+-position: 61 mol%) obtained by isomerizing $C_{16}$–$C_{20}$ α-olefins (a mixture of Dialen 16, Dialen 18 and Dialen 20, products of Mitsubishi Chemical Industries, Ltd.)(carbon number distribution: 16, 50 wt%; 18, 30 wt%; 20, 20 wt%), 603 g of maleic anhydride (the same product used in Example 1) (molar ratio: 1.5) was added, followed by reacting in an autoclave at 215° C. for 8 hours without using a catalyst. After removing the unreacted olefin and maleic anhydride from the reaction mixture by distilling under reduced pressure, 1,342 g of olefin/maleic anhydride addition reaction products were obtained. The content of the 1:2 adduct and the decarbonated product thereof was 9.1 mol%.

COMPARATIVE EXAMPLE 4

The procedure of Example 5 was repeated except that the amount of the maleic anhydride was reduced to 402 g (molar ratio: 1.0). As a result, 1,125 g of olefin/maleic anhydride addition reaction products were obtained and the content of the 1:2 adduct and the decarbonated product thereof was 4.5 mol%.

COMPARATIVE EXAMPLE 5

The procedure of Example 5 was repeated except that the amount of the maleic anhydride was increased to 764 g (molar ratio: 1.9). As a result, 1,491 g of olefin/maleic anhydride addition reaction products were obtained and the content of the 1:2 adduct and the decarbonated product thereof was 13.4 mol%.

The olefin/maleic anhydride addition reaction products obtained in the above Examples 1 to 5 and Comparative Examples 1 to 5 were subjected to an emulsification test, a contamination test and were evaluated as to sizing effect.

Emulsification Test

To 10 g of each olefin/maleic anhydride addition reaction products obtained in the above Examples and Comparative Examples, 0.5 g of polyoxyethylene nonyl phenyl ether (HLB 13), employed as an emulsifier, was added and mixed well. To 1 g of the mixture thus obtained, 99 g of a 1.5 % by weight solution of cationic starch (Cato 15 (tradename), a product of Oji National K.K.) was added and the obtained mixture was emulsified in a TK Homomixer Model M (a product of Tokushu Kika Kogyo, K.K.) at 7,000 rpm for 2 minutes. The particle size distribution of the emulsion thus obtained was determined with a Microtrac SPA (a product of Leeds & Northtrup Instruments Co.). Table 1 shows the results.

TABLE 1

| | Particle size distribution (wt %) | | |
|---|---|---|---|
| | <0.43 μm | 0.43-2.6 μm | >2.6 μm |
| Ex. 1 | 10.4 | 69.3 | 20.3 |
| Ex. 2 | 9.0 | 69.2 | 21.8 |
| Ex. 3 | 8.0 | 69.0 | 23.0 |
| Ex. 4 | 10.1 | 68.8 | 21.1 |
| Ex. 5 | 8.2 | 68.9 | 22.9 |
| C. Ex. 1 | 22.5 | 58.8 | 18.7 |
| C. Ex. 2 | 20.0 | 60.4 | 19.6 |
| C. Ex. 3 | 7.5 | 53.9 | 38.6 |
| C. Ex. 4 | 21.0 | 59.5 | 19.5 |
| C. Ex. 5 | 7.3 | 52.8 | 39.9 |

Each emulsion prepared as above was subjected to the following contamination test and was also evaluated as to sizing effect as discussed below.

Contamination Test

A simulation test on the contamination of a paper machine was carried out with the use of a contamination test machine as shown in the Figure. This contamination test machine consisted of a slurry box 1 (liquid surface area: 600 $cm^2$), a circulation pump 2, a slurry box 3 and a slope 4. The slope was made of specular stainless (length: 30 cm, width: 20 cm) and had an incremental angle of 10°. To begin with, a 0.5% by weight pulp slurry (L. B. KP, 450 ml CSF) was fed into the slurry box. Then 0.5% by weight of aluminum sulfate, 0.8% by weight of cationized starch, 0.1% by weight of an emulsion (the same one as the sample used in the above emulsification test), 20% by weight of calcium carbonate heavy and 0.03% by weight of cationic polyacrylamide, each based on the solid content of the pulp, were added thereto under stirring at 200 rpm. Then the circulation pump was operated so as to circulate the mixture [box 1→box 3→slope 4→box 1] at a rate of 3 L/min. After circulating for 2 hours, the foaming scum and contamination in the box 1 were evaluated with the naked eye and the foaming scum was weighed. Table 2 shows the results.

TABLE 2

| | Foam and contamination | Foam wt. (g) |
|---|---|---|
| Ex. 1 | Little foam and contamination after 1 hour. | 0.4 |
| Ex. 2 | Little foam and contamination just before the completion of Test. | 0.1 |
| Ex. 3 | None. | 0 |
| Ex. 4 | None. | 0 |
| Ex. 5 | None. | 0 |
| C. Ex. 1 | Much foam and serious contamination after 10 min. | 2.3 |
| C. Ex. 2 | Much foam and serious contamination after 15 min. | 1.9 |
| C. Ex. 3 | None. | 0 |
| C. Ex. 4 | Much foam and serious contamination after 20 min. | 1.8 |
| C. Ex. 5 | None. | 0 |

Evaluation of Sizing Effect

Each emulsion was added to a 1% by weight pulp slurry (L. B. KP, 430 ml, CSF) in such a manner as to give contents of the olefin/maleic anhydride addition reaction products of 0.1, 0.15 and 0.2% by weight (based on the solid content of the pulp), respectively. Next, 0.8% by weight (based on the solid content of the pulp) of cationized starch and 0.03% by weight (based on the solid content of the pulp) of cationic polyacrylamide were added thereto, followed by producing paper sheets in accordance with the method specified in JIS-P8209. As a filler, 20% by weight (based on the solid content of the pulp) of calcium carbonate heavy was used.

Subsequently, the moist paper sheets thus obtained were dehydrated under compression, dried by heating to 105° C. for 1 minute in a rotating drier and then subjected to moisture conditioning in a room of a relatively humidity of 65% for 24 hours. Thus hand-made paper sheets of 65 $g/m^2$ were obtained. The degree of sizing of each hand-made paper sheet thus obtained was determined by Stöckigt's sizing test specified in JIS-P8122. Separately, the sizing agent emulsion prepared above was allowed to stand for 2 hours and then hand-made paper sheets were produced by the same method as the one described above, followed by determining the degree of sizing. Table 3 shows the results.

TABLE 3

| | Stöckigt's degree of sizinc (sec.) | | | |
|---|---|---|---|---|
| Test period: | Just after emulsification | | | After 2 hrs |
| Added sizing agent: | 0.1 wt % | 0.15 wt % | 0.2 wt % | 0.2 wt % |
| Ex. 1 | 7 | 18 | 29 | 27 |
| Ex. 2 | 6 | 16 | 28 | 27 |
| Ex. 3 | 6 | 15 | 25 | 25 |
| Ex. 4 | 7 | 15 | 26 | 24 |
| Ex. 5 | 7 | 16 | 26 | 24 |
| C. Ex. 1 | 4 | 13 | 22 | 19 |
| C. Ex. 2 | 5 | 12 | 20 | 17 |
| C. Ex. 3 | 2 | 7 | 15 | 14 |
| C. Ex. 4 | 5 | 13 | 23 | 18 |
| C. Ex. 5 | 1 | 6 | 13 | 12 |

The sizing agent composition of the present invention shows an excellent emulsifiability and a high stability after the completion of emulsification. Therefore, it not only exhibits an excellent sizing effect but also relieves the contamination of a paper machine.

While the invention has been described in detail and with reference to specific embodiments thereof, it will be apparent to one skilled in the art that various changes and modifications can be made therein without departing from the spirit and scope thereof.

What is claimed is:

1. A paper sizing agent composition comprising addition reaction products obtained from an addition reaction between a straight-chain internal olefin comprising 16 to 20 carbon atoms and maleic anhydride, any unreacted olefin and maleic anhydride having been removed from said addition reaction products; said addition reaction products comprising as a main component alkenylsuccinic anhydride (1:1 adduct) represented by formula (I):

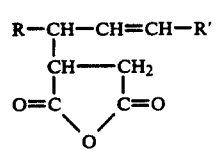

(I)

wherein both of R and R′ are alkyl groups or either one of R and R′ is an alkyl group while the other is a hydrogen atom; and a 1:2 adduct (2 moles maleic anhydride per mole of olefin), and a decarbonated product of said 1:2 adduct in a total amount, based on said addition reaction products, of from about 7 to about 12 mol%.

2. The paper sizing agent composition as in claim 1, wherein said addition reaction is conducted in the absence of a catalyst at a temperature of from 180° to 250° C. under an inert gas atmosphere from 1 to 30 hours, and from 0.5 to 3 moles of maleic anhydride are used as a starting amount per mole of said olefin.

3. The paper sizing agent composition as in claim 1, wherein the composition is emulsified with from 0.5 to 20% by weight, based on the weight of the addition reaction products, of an emulsifier.

4. The paper sizing agent composition as in claim 3, further comprising a cationic compound as a suspending agent in an amount of from 30 to 600% by weight based on the weight of the addition reaction products.

5. The paper sizing agent composition as in claim 4, wherein said emulsifier is present in an amount of from 1 to 10% by weight, and said cationic compound is present in an amount of from 100 to 300% by weight, each based on the weight of the addition reaction products.

6. The paper sizing agent composition as in claim 1, further comprising a filler selected from the group consisting of talc, clay, titanium dioxide, calcium carbonate, calcium sulfate and aluminum hydroxide.

7. The paper sizing agent composition as in claim 1, wherein said addition reaction products further comprises a trace amount of 1:3 adduct (3 moles of maleic anhydride per mole of olefin) in an amount of 0.5% by weight or less based on the weight of the addition reaction products.

* * * * *